US007855707B2

(12) United States Patent
Park et al.

(10) Patent No.: US 7,855,707 B2
(45) Date of Patent: Dec. 21, 2010

(54) LIQUID CRYSTAL DISPLAY DEVICE AND DRIVING METHOD THEREOF

(75) Inventors: Jea Seok Park, Daegu (KR); Yong Ju Jeon, Daejeon (KR)

(73) Assignee: LG Display Co., Ltd., Seoul (KR)

( * ) Notice: Subject to any disclaimer, the term of this patent is extended or adjusted under 35 U.S.C. 154(b) by 1022 days.

(21) Appl. No.: 11/646,551

(22) Filed: Dec. 28, 2006

(65) Prior Publication Data

US 2007/0262310 A1 Nov. 15, 2007

(30) Foreign Application Priority Data

May 11, 2006 (KR) ..... 10-2006-0042193

(51) Int. Cl.
*G09G 3/36* (2006.01)

(52) U.S. Cl. ..... 345/94; 345/100; 345/209; 345/213; 345/690

(58) Field of Classification Search ..... 345/89, 345/94, 96, 98–100, 209, 211–214, 690, 345/691

See application file for complete search history.

(56) References Cited

U.S. PATENT DOCUMENTS 6,327,008 B1 12/2001 Fujiyoshi
7,385,576 B2 * 6/2008 Moon ..... 345/87
2003/0090449 A1 5/2003 Arimoto et al.
2003/0179221 A1 9/2003 Nitta et al.
2004/0239602 A1 12/2004 Kim et al.
2005/0270873 A1 12/2005 Lee et al.
2006/0041805 A1 * 2/2006 Song ..... 714/724

FOREIGN PATENT DOCUMENTS

| | | |
|---|---|---|
| JP | 63-74036 | 4/1988 |
| JP | 11-282434 | 10/1999 |
| JP | 2001-42282 | 2/2001 |
| JP | 2001-60078 | 3/2001 |
| JP | 2003-066928 | 3/2003 |
| JP | 2004-271719 | 9/2004 |

* cited by examiner

*Primary Examiner*—Henry N Tran
(74) *Attorney, Agent, or Firm*—McKenna Long & Aldridge LLP

(57) ABSTRACT

A liquid crystal display device includes: a liquid crystal panel; a horizontal sync signal having a horizontal period; a gate driver that supplies a plurality of gate signals sequentially to a plurality of gate lines, wherein a first gate line provides a gate signal with a gate pulsewidth equal to the horizontal period +α and a second gate line provides a gate signal with a gate pulsewidth equal to the horizontal period +α so that gates signals on the first and second gate lines overlay by 2α and wherein the first and second gate lines are adjacent to one another; and a data driver that supplies pixel data signals to a plurality of data lines on the liquid crystal panel during every period of the horizontal sync signals.

17 Claims, 9 Drawing Sheets

FIG. 3A

ODD FRAME

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

FIG. 3B

EVEN FRAME

| | | | | | | | |
|---|---|---|---|---|---|---|---|
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |

LIQUID CRYSTAL DISPLAY DEVICE AND DRIVING METHOD THEREOF

This application claimed the benefit of Korean Patent Application No. 10-2006-0042193, filed on May 11, 2006, which is hereby incorporated by reference for all purposes as if fully set forth herein.

BACKGROUND OF THE INVENTION

1. Field of the Invention

The present invention relates to a liquid crystal display device and, more particularly, to a liquid crystal display device that secures sufficient writing time to store video signals at a high frame frequency and driving method thereof.

2. Discussion of the Conventional Art

As the information age advances, the requirements of display devices are increasing. To satisfy these requirements, some of the various flat display devices such as a liquid crystal display device (LCD), a Plasma Display Panel (PDP), and a Electro Luminescent Display (ELD) have been developed, and some are already used as display devices in many types of equipment.

Among the above-mentioned devices, the liquid crystal display device is currently the most widely used to substitute for cathode ray tube displays for use in mobile image display devices with the advantages of high video quality, light weight, thin form, low power consumption, and liquid display devices have been developed and not just for mobile devices such as monitors of notebook computers, but also for television monitors.

The liquid display device displays images using the optical anisotropy and the polarizing quality of the liquid crystal. The liquid molecules included in the liquid crystal may be arranged in a predetermined or a regular direction. Also, the arrangement direction of the molecules of the liquid may be controlled by an electric field applied to the liquid crystal. Therefore, if the arrangement direction of the molecules of the liquid is controlled, the arrangement direction of the liquid crystal molecules is changed, and image information is presented by changing the polarized state of the light in the arrangement direction of the molecules of the liquid due to the optical anisotropy.

The liquid crystal display device as describe above has a liquid crystal panel that displays an image, and a drive unit operating the liquid panel. The liquid crystal panel has a liquid crystal layer formed between the two substrates. One of the substrates has pixel electrodes in each of the pixel regions divided by a plurality of gate lines and a plurality of data lines crossing each other. A liquid crystal cell includes a pixel electrode, a common electrode formed on one of the two substrates, and a portion of the liquid crystal layer. Further, each crossing of the gate lines and the data lines includes a thin film transistor. The thin transistor switches the supplied data signals to the corresponding pixel electrode from the corresponding data lines in response to the gate signals (or scan signals) on the corresponding gate lines. The liquid crystal cells in the liquid crystal panel are sequentially accessed line by line with the data signals supplied to the plurality of data lines whenever the plurality of gate lines are enabled sequentially by the gate signals. Accordingly, images corresponded to the video data are displayed by controlling the arrangement direction of the liquid crystal molecules.

The drive unit includes: a gate driver driving the gate lines on the liquid crystal panel; a data driver driving the data lines on the liquid crystal panel; and a timing controller controlling the driving timing of the gate driver and the data driver.

Furthermore, the liquid crystal display device includes a back light unit irradiating light to the liquid crystal panel.

The liquid crystal display device described as above drives the liquid crystal panel with a frame frequency of 60 Hz. That is, the liquid crystal display device displays 60 pages of pictures per second. When the video pictures are displayed on a liquid crystal panel with a frame frequency of 60 Hz, motion blurring is generated. Accordingly, it was difficult to display motion pictures with good quality through the liquid crystal display device driving the liquid crystal panel at a frame frequency of 60 Hz.

To overcome the above-mentioned disadvantage, a liquid crystal display device driving the liquid crystal panel at a frame frequency of 120 Hz is being proposed. The liquid crystal display device with the frame frequency of 120 Hz exchanges images at a speed twice as fast as the liquid crystal display device with a frame frequency of 60 Hz.

In another solution that has been proposed, a pseudo-impulsive liquid crystal display device drives the liquid crystal cells in the liquid crystal panel in a form of impulse. The pseudo-impulsive liquid crystal display device writes data signals and black signals alternatively on the liquid crystal cell of the liquid crystal panel. The liquid crystal panel is also driven at 120 Hz in the pseudo-impulsive liquid crystal display device. On each of the liquid crystal cells on the liquid crystal panel, video signals and black signals are displayed 60 times alternatively. That is, the liquid crystal panel is also driven at 120 Hz in the pseudo-impulsive system.

As described above, when the liquid crystal panel is driven at a frame frequency of 120 Hz, the enabling period of each of the gate lines on the liquid crystal panel is reduced in half as compared with the liquid crystal display device with a frame frequency of 60 Hz. Accordingly, sufficient time for the data signals to be written on the cells of the liquid crystal as passing through the thin film transistor is difficult to achieve. Further, the quality of the pictures displayed using the liquid crystal display device of frame frequency of 120 Hz becomes lower.

SUMMARY OF THE INVENTION

Accordingly, the present invention is directed to a liquid crystal display device and driving method thereof that substantially obviates one or more of the problems due to limitations and disadvantages of the related art.

An advantage of the present invention is to provide a liquid crystal display device capable of providing sufficient writing time of video signals even at a high frame frequency and driving method thereof.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes: a liquid crystal panel; a horizontal sync signal having a horizontal period; a gate driver that supplies a plurality of gate signals sequentially to a plurality of gate lines, wherein a first gate line provides a gate signal with a gate pulsewidth equal to the horizontal period+$\alpha$ and a second gate line provides a gate signal with a gate pulsewidth equal to the horizontal period+$\alpha$ so that gates signals on the first and second gate lines overlap by $2\alpha$ and wherein the first and second gate lines are adjacent to one another; and a data driver that supplies pixel data signals to a plurality of data lines on the liquid crystal panel during every period of the horizontal sync signals.

In another aspect of the present invention, a liquid crystal display device includes: a liquid crystal pane; a horizontal sync signal having a horizontal period; a gate driver that supplies a plurality of gate signals sequentially to a plurality of gate lines, wherein a first gate line provides a gate signal with a gate pulsewidth equal to the horizontal period+α and a second gate line provides a gate signal with a gate pulsewidth equal to the horizontal period+α so that gates signals on the first and second gate lines overlap by 2α and wherein the first and second gate lines are adjacent to one another; and a data driver that produces pixel data signals corresponding to a plurality of data lines on the liquid crystal panel during each period of the horizontal sync signals; and a signal selector connected to the data driver that supplies a black data signal and the pixel data signals from the data driver alternatively to the data lines.

In another aspect of the present invention, a driving method of a liquid crystal display device includes: supplying a plurality of gate signals sequentially to a plurality of gate lines, wherein a first gate line provides a gate signal with a gate pulsewidth equal to the horizontal period+α and a second gate line provides a gate signal with a gate pulsewidth equal to the horizontal period+α so that gates signals on the first and second gate lines overlap by 2α and wherein the first and second gate lines are adjacent to one another; and supplying pixel data signals to a plurality of data lines on the liquid crystal panel during every period of the horizontal sync signals.

In another aspect of the present invention, a driving method of a liquid crystal display device includes: supplying a plurality of gate signals sequentially to a plurality of gate lines, wherein a first gate line provides a gate signal with a gate pulsewidth equal to the horizontal period+α and a second gate line provides a gate signal with a gate pulsewidth equal to the horizontal period+α so that gates signals on the first and second gate lines overlap by 2α and wherein the first and second gate lines are adjacent to one another; and producing pixel data signals corresponding to a plurality of data lines on the liquid crystal panel during each period of the horizontal sync signals; and supplying a black data signal and the pixel data signals alternatively to the data lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings:

FIG. 3A is a view illustrating the polarity distribution of a liquid crystal panel charged with a video data of an odd-numbered frame in the dot end frame inversion method.

FIG. 3B is a view illustrating the polarity distribution of a liquid crystal panel charged with a video data of an even-numbered frame in the dot and frame inversion method.

DETAILED DESCRIPTION OF THE PREFERRED EMBODIMENTS

Reference will now be made in detail to an embodiment of the present invention, examples of which are illustrated in the accompanying drawings.

Figure 1:
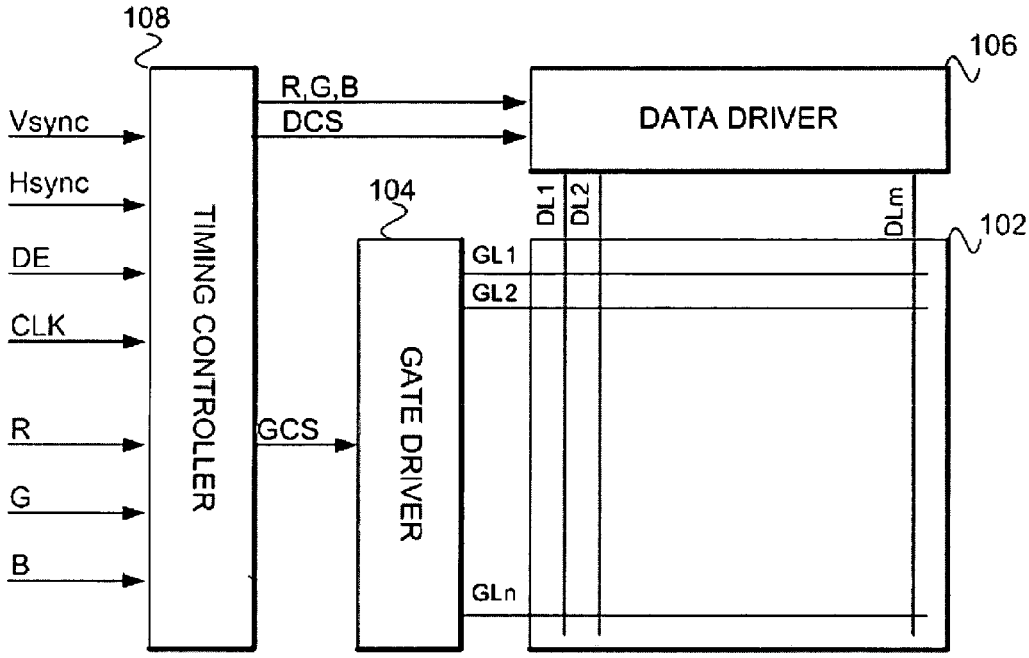
FIG. 1 is a block diagram schematically illustrating a liquid crystal display device according to the first embodiment of the present invention.

FIG. 1 is a block diagram schematically illustrating a liquid crystal display device according to the first embodiment of the present invention. Referring to FIG. 1, the liquid crystal display device according to an embodiment of the present invention includes a gate driver 104 driving a plurality of gate lines GL1 to GLn on the liquid crystal panel 102 and a data driver 106 driving a plurality of data lines DL1 to DLm on the liquid crystal panel 102. The liquid crystal panel 102 is divided into a plurality of pixel regions by the gate lines GL1 to GLn and the data lines DL1 to DLm crossing each other. A pixel is formed in each of the pixel regions, as shown in FIG. 2.

Figure 2:
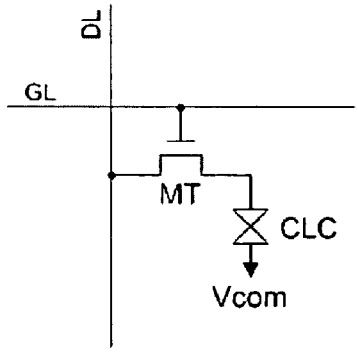
FIG. 2 is a circuit diagram illustrating the pixel formed on a liquid crystal panel of FIG. 1 in detail.

The pixel shown in FIG. 2 includes a thin film resistor MT and a liquid crystal cell CLC connected in series between the corresponded data line DL and the common electrode Vcom. The thin film transistor MT is responsive to the gate signals (or scan signals) on the corresponding gate line GL and switches the data signal to be supplied to the corresponding liquid crystal cell CLC from the corresponding data line DL. Though it is not illustrated, the liquid crystal cell CLC includes a liquid crystal layer between the two substrates and a pixel electrode and a common electrode on the two substrates or both formed on one of the two substrates. The pixel electrode is connected to the thin film transistor MT. The liquid crystal cell CLC described above changes the arrangement of the molecules of the liquid crystal by the electric potential difference between the data signal from the thin film transistor MT on the pixel electrodes and the common voltage on the common electrode Vcom. Accordingly, the image corresponding to the video data is displayed on the liquid crystal panel 102, as the amount of light passing through the liquid crystal cell CLC is changed.

Figure 4:
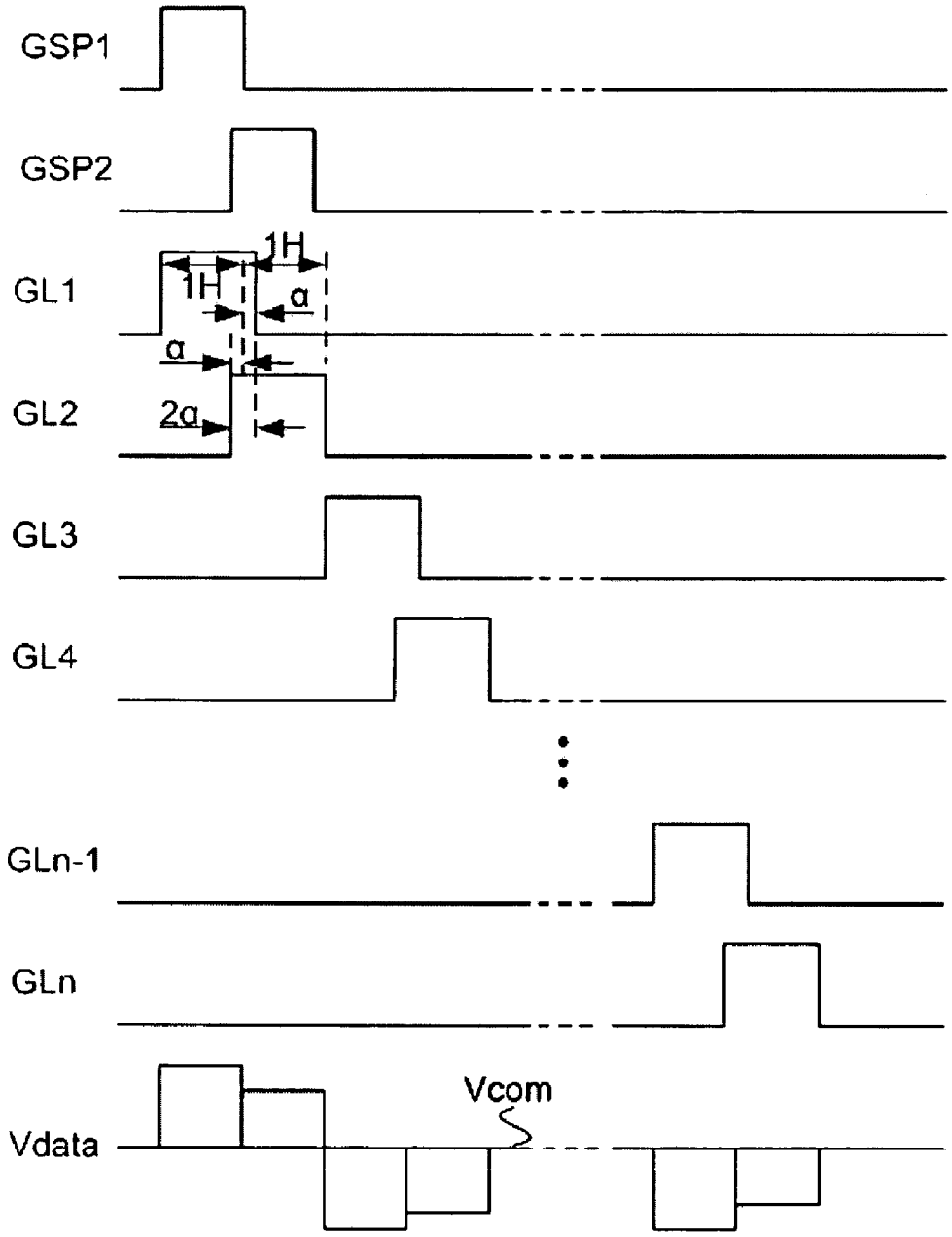
FIG. 4 is a waveform view illustrating gate signals and pixel signals generated in the liquid crystal display device of FIG. 1.

Back to FIG. 1, the gate driver 104 generates a plurality of gate signals enabling the gate lines GL1 to GLn on the liquid crystal panel 102 sequentially. Each of the plurality of gate signals, as shown in FIG. 4, has a period that is 'α' longer than the period of a horizontal sync signal. The time 'α' is set to be shorter than the period of scanning time of the horizontal sync signal. The gate signal on odd number gate lines among the plurality of gate signals have the same phase with the horizontal sync signal and the gate signal on even number gate lines have a phase that is ahead as much as 'α'. As a result, the gate signal on an odd number gate line and the gate signal on an even number gate line next to the odd number gate line overlap by '2α'. Accordingly, each of the odd-numbered gate lines GL1, GL3, . . . , GLn−1 on the liquid crystal panel 102 is enabled with the even-numbered gate lines GL2, GL4, . . . , GLn at the same time during the period of '2α' and are enabled exclusively during the period of '1H−α'.

The data driver 106 charges the liquid crystal cells CLC with the data signals to a plurality of data lines DL1 to DLm during the period of one horizontal sync signal, whenever one of the gate lines on the liquid crystal panel 102 is enabled. For this, the data driver 106 inputs a pixel data for one line at every cycle of the horizontal sync signal, and converts the pixel data for one line into the pixel data signals in an analog form.

The converted pixel data signals are supplied to each of the data lines DL1 to DLm of the liquid crystal panel 102. The pixel data for one line includes red, green and blue data. Accordingly, the pixel data signals also includes R, G and B pixel data signals. Further, pixel data signals generated from the data driver 106 has a positive polarity voltage and a negative polarity voltage alternatively with respect to the common voltage Vcom. That is, the liquid crystal panel 102 is driven with a frame inversion method.

As described above, pixel data signals having opposite polarities at adjacent pairs of pixels along the data line or along the column are charged on the liquid crystal cells CLC of the liquid crystal panel 102. The adjacent pairs of liquid crystal cells along the column where the pixel data signals with the same polarity along the data line are both charged during a period of '2α' where the respective gate signals overlap. Each of the liquid crystal cells CLC on the odd-numbered gate lines GL1, GL3, . . . GLn−1 charges the pixel data signal to be supplied to a next even-numbered gate line GL2, GL4, . . . , GLn during the additional period of 'α' after charging the pixel data signal to be supplied to itself during the period of one horizontal sync signal. Meanwhile, each of the liquid crystal cells CLC on the even-numbered gate lines GL2, GL4, . . . , GLn charges the pixel data signals to be supplied to itself during the period of one horizontal sync signal after charging the pixel data signal from the previous odd-numbered gate line during the additional period of 'α'. Accordingly, the liquid crystal cells CLC on the liquid crystal panel 102 have sufficient time to charge the pixel data signals, even at a high frame frequency. Therefore, the liquid crystal display device according to the present invention is capable of improving the video quality corresponding to the video data of a high frame frequency.

The liquid crystal display device of FIG. 1 has a timing controller 108 controlling the driving timing of the gate driver 104 and the data driver 106. The timing controller 108 generates gate control signals GCS to control the driving timing of the gate driver 104 and data control signals DCS to control the driving timing of the data driver 106 using vertical sync signal Vsync, horizontal sync signal Hsync, data enable signal DE and clock signal CLK from external systems that produce the desired images, such as graphic modules of computer systems or video demodulating modules of television systems.

The data signal DCS includes source enable signal SOE, clock signal CLK and polarity inversion signal POL. The polarity inversion signal POL inverts the polarity of the pixel data signals every two gate lines. Further, the polarity inversion signal POL inverts the polarity of the pixel data signal to be supplied to the liquid crystal cells on the liquid crystal panel 102 every frame.

For instance, on the assumption that the polarity inversion signal POL has specific logic (that is, high logic) on the odd-numbered frames, and has base logic (for example, low logic) on the even-numbered frames, the pixel data signals generated at the odd-numbered frames have the positive polarity and the negative polarity alternatively at each of the two pixels (or pixel cells) progressing from the top of the left side of the liquid crystal panel 102 in the horizontal and vertical directions, as depicted in FIG. 3A. On the contrary, the pixel data signals of the even-numbered frames have the negative polarity and the positive polarity alternatively at each of the two pixels (or pixel cells) progressing from the top of the left side of the liquid crystal panel 102 in the horizontal and vertical directions, as depicted in FIG. 3B.

The gate control signals GCS include the first and the second gate start pulses GSP1 and GSP2 and at least two shift clocks. The first gate start pulse GSP1 is used to generate the gate signals to be supplied to the odd-numbered gate lines GL1, GL3, . . . GLn−1, and the second gate start pulse GSP2 is used to generate the gate signals to be supplied to the even-numbered gate lines GL2, GL4, . . . , GLn. Further, the horizontal sync signals Hsync and the phase of the first gate start pulse GSP1 are the same, however, the second gate start pulse GSP2 has a phase that is 'α' ahead of the horizontal sync signals Hsync. That is, the second gate start pulse GSP2 has its phase advanced as much as 'α' that is reduced from the period of one horizontal sync signal (that is, '1H−α'), compared with the first gate start pulse GSP1. Accordingly, each of the gate signals to be supplied to the odd-numbered gate lines GL1, GL3, . . . , GLn−1 overlap with the nearby gate signals supplied to the even-numbered gate lines GL2, GL4, . . . , GLn by a period of '2α'. Accordingly, each of the liquid crystal cells CLC on the odd-numbered gate lines GL1, GL3, . . . , GLn−1 charges the pixel data signals to be supplied to the next even-numbered gate line GL2, GL4, . . . , GLn during the additional period of 'α' after charging the data signals to be supplied to itself, during the period of one horizontal sync signals. Meanwhile, each of the liquid crystal cells CLC on the odd-numbered gate lines GL2, GL4, . . . , GLn charges the pixel data signals to be supplied to itself during the period of one horizontal sync signals after charging the pixel data signals to be supplied to the liquid crystal cells on the previous odd-numbered gate lines GL1, GL3, . . . , GLn−1 during the additional period of 'α'. The pixel data signals to be supplied to the liquid crystal cells on the odd-numbered gate lines GL1, GL3, . . . , GLn−1 and the pixel data signals to be supplied to the liquid crystal cells on the even-numbered gate lines GL2, GL4, . . . , GLn have the same polarity. Therefore, the liquid crystal cells CLC on the liquid crystal panel 102 may provide sufficient time to charge pixel data signals, even at a high frame frequency. The liquid crystal display device according to the present invention is capable of improving the video quality of the images corresponded to the video data of high frame frequency.

Further, the timing controller 108 inputs the R, G and B pixel data of the frame from external systems. The R, G and B pixel data of the frame are rearranged line by line by the timing controller 108. The R, G and B pixel data of the frames rearranged as above are supplied to the data driver 106 line by line. Then, the data driver 106 converts the R, G and B pixel data for one line into the analog R, G and B pixel data signals used to drive the pixels in every cycle of horizontal sync signals. Each of the analog R, G and B pixel data signals is charged onto the liquid crystal cells onto each line through each of the plurality of data lines DL1 to DLm on the liquid crystal panel 102 during one horizontal sync signal.

Accordingly, each of the pixel data signals may be charged to the liquid crystal cells on the liquid crystal panel 102 as the charging time of the liquid crystal cells on the liquid crystal panel 102 becomes longer than the period of the horizontal sync signal.

Figure 5:
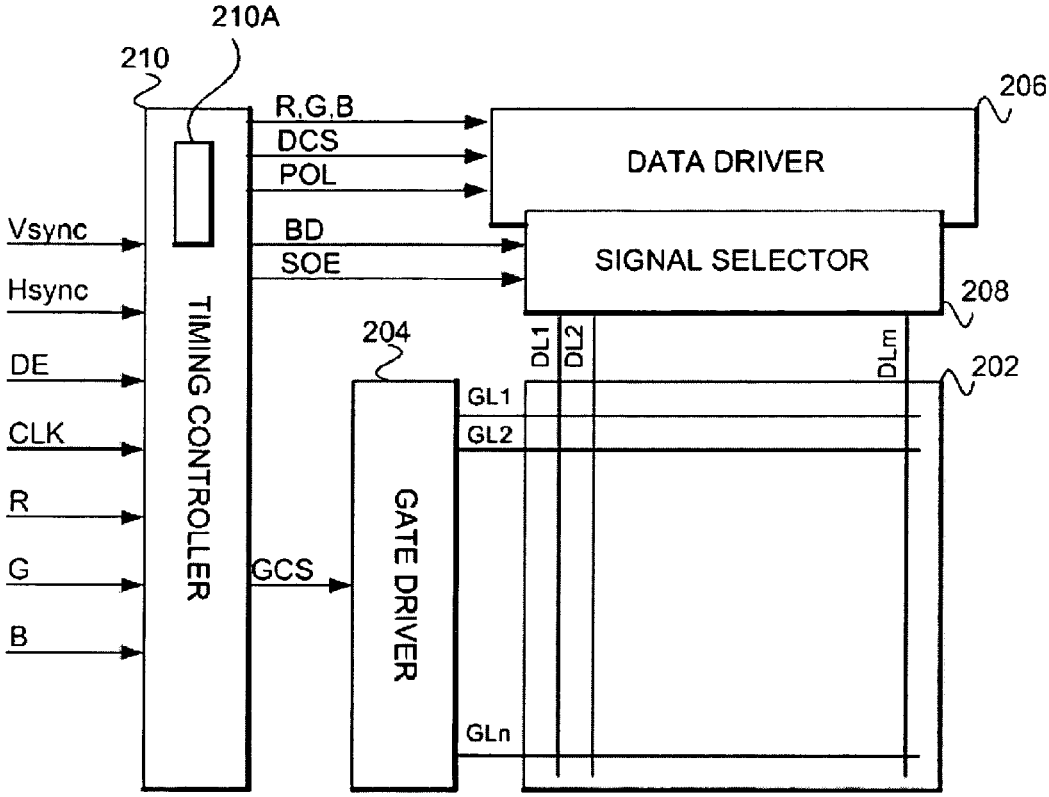
FIG. 5 is a block diagram schematically illustrating a liquid crystal display device according to another embodiment of the present invention.

FIG. 5 is a block diagram schematically illustrating a liquid crystal display device according to another embodiment of the present invention. The liquid crystal display device of FIG. 5 includes: a gate driver 204 driving a plurality of gate lines GL1 to GLn on the liquid crystal panel 202; a data driver 206 driving a plurality of data lines DL1 to DLm on the liquid crystal panel 202; and a signal selector 208 connected between the data lines DL1 to DLm on the liquid crystal panel 202 and the data driver 206. The liquid crystal panel 202 has the same configuration as the liquid crystal panel 102 shown in FIG. 1. Therefore, description on the configuration, operation and function of the liquid crystal panel 202 are omitted, as its description is the same as the liquid crystal panel 102 of FIG. 1.

Figure 6A:
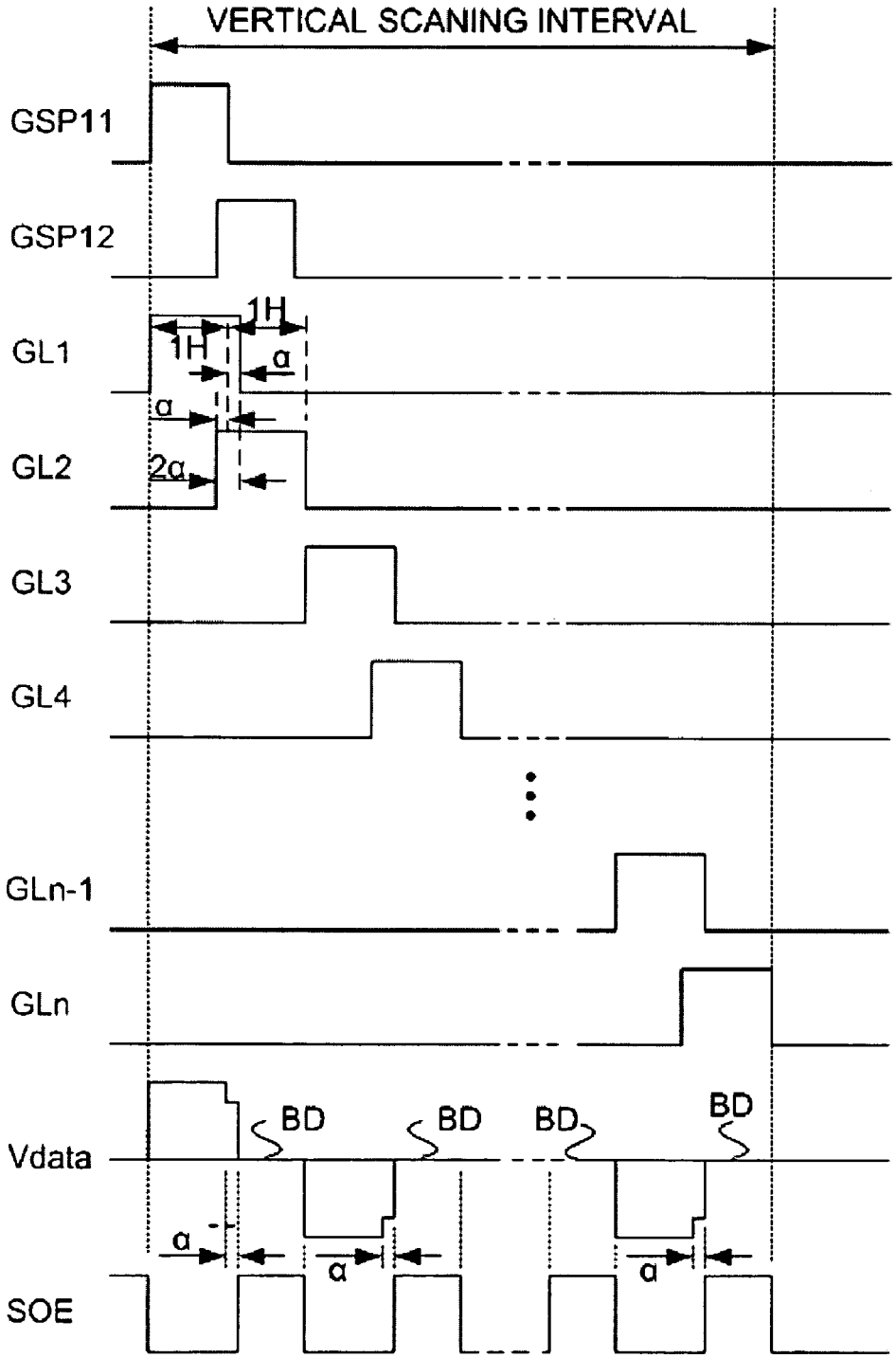
FIG. 6A is a waveform illustrating the signals output from each of the parts of the liquid crystal display device of FIG. 5, at odd numbered frames.
Figure 6B:
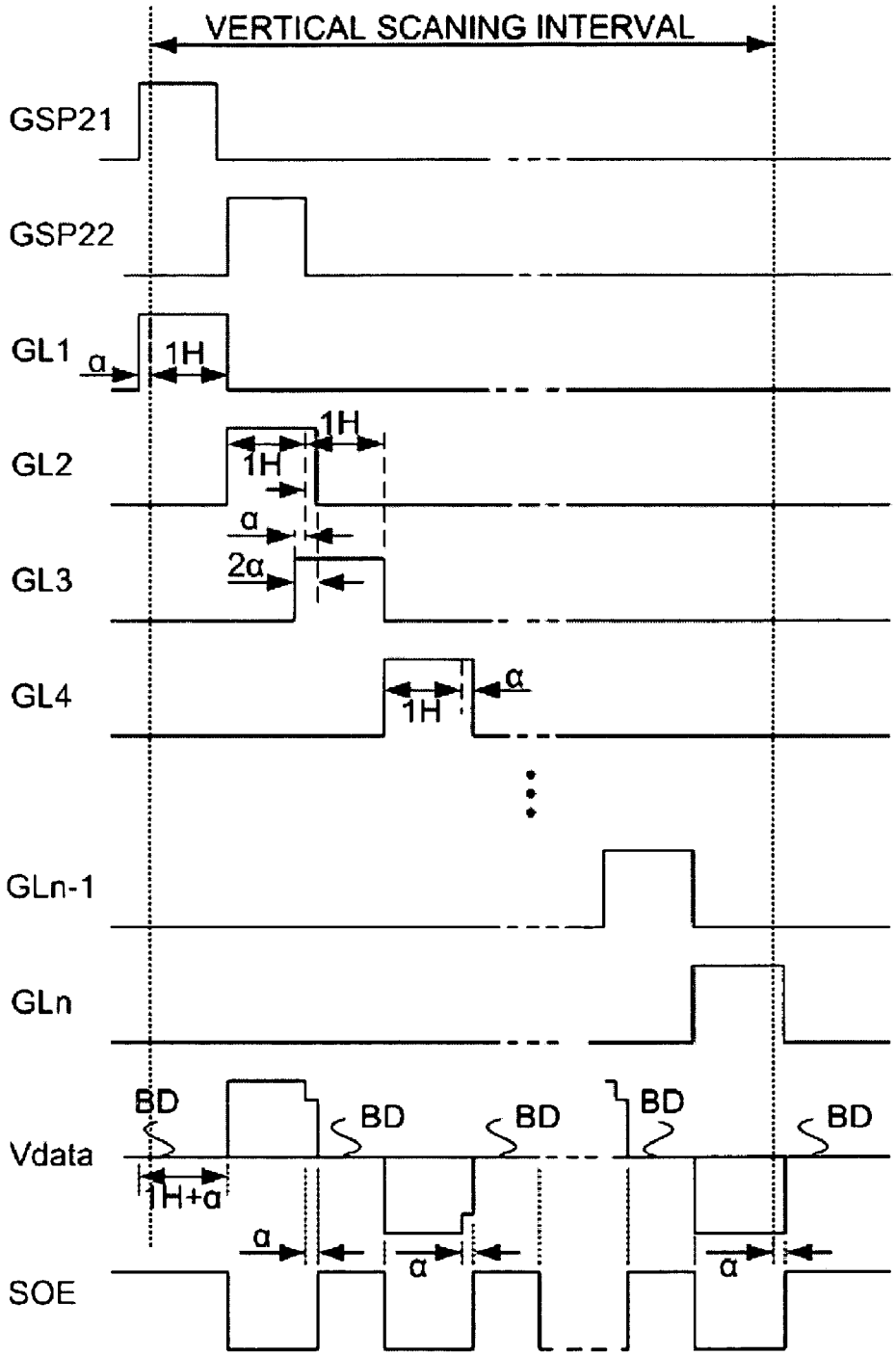
FIG. 6B is a waveform illustrating the signals output from each of the parts of the liquid crystal display device of FIG. 5, at even-numbered frames.

The gate driver 204 generates a plurality of gate signals enabling the gate lines GL1 to GLn on the liquid crystal panel 202 sequentially. Each of the gate signals have a period that is '$\alpha$' longer than the period of one horizontal sync signal as depicted in FIGS. 6A and 6B. Accordingly, each of the gate lines GL 1 to GLn is enabled for a longer period 1H+$\alpha$ than the period of horizontal sync signals. The period '$\alpha$' is set ash shorter than the scanning time of the horizontal sync signals. The gate signals to be supplied to the odd-numbered gate lines GL1, GL3, . . . , GLn−1 and the gate signals to be supplied to the even-number gate lines GL2, GL4, . . . , GLn have different phases in accordance with the odd-numbered frame (that is, the vertical sync period of odd number) and the even-numbered frame (that is, the vertical sync period of even number).

Referring to FIG. 6A, during the odd-numbered frame, the gate signals on the odd-numbered gate lines GL1, GL3, GLn−1 have the same phase as the horizontal sync signal, but the gate signals on the even-numbered gate lines GL2, GL4, . . . , GLn have phases that are advanced by '$\alpha$' versus the horizontal sync signals. Each of the gate signals on the odd-numbered gate lines GL1, GL3, GLn−1 overlaps the gate signal on the even-numbered gate lines GL2, GL4, . . . , GLn next to the odd-numbered gate lines GL1, GL3, . . . , GLn−1 by a period of '2$\alpha$'. The odd-numbered gate signal and the next even-numbered gate signal occupy the period of the two horizontal sync signals. Accordingly, the odd-numbered gate lines GL1, GL3, GLn−1 and the next even-numbered gate lines GL2, GL4, . . . , GLn are enabled at the same time during the overlap period of '2$\alpha$'.

As described in FIG. 6B, during the even-numbered frame, the gate signals on the odd-numbered gate lines GL1, GL3, . . . , GLn−1 have phases that are advanced by '$\alpha$' versus the horizontal sync signals, however, the gate signals on the even-numbered gate lines GL2, GL4, . . . , GLn have the same phase as the horizontal sync signals. During the even frames, each of the gate signals on the even-numbered gate lines GL2, GL4, . . . , GLn−2 overlaps the gate signals on the next odd-numbered gate line GL1, GL3, . . . , GLn−1 by a period of '2$\alpha$'. The even-numbered gate signals and the next odd-numbered gate signals occupy the period of the two horizontal sync signals. Accordingly, the even-numbered gate lines GL2, GL4, . . . , GLn−2 and the next odd-numbered gate lines GL3, GL5, . . . , GLn−1 are enabled at the same time during the overlap period of '2$\alpha$'. In this case, the gate signals supplied to the first gate line GL1 has a phase advanced by '$\alpha$' versus the vertical scanning pulse, but the gate signal to be supplied to the last gate line GLn becomes longer by '$\alpha$' versus the finishing time of the vertical scanning pulse.

The data driver 206 charges the voltage of the pixel data signal on the liquid crystal cells CLC of one line by supplying the pixel data signals for one line to a plurality of data lines DL1 to DLm during the period of 1H+$\alpha$. For the odd-numbered frame (tat is an odd-numbered vertical scanning interval), the data driver 206 outputs the pixel data signals for one line when the odd-numbered gate lines GL1, GL3, . . . , GLn−1 are enabled. For the even-numbered frame (that is, the even-numbered vertical scanning interval), the data driver 206 outputs the pixel data signals for the line when the even-numbered gate lines GL2, GL4, . . . , GLn are enabled. For this, the data driver 206 inputs the pixel data for one line during every period of two horizontal sync signal, and converts the input pixel data for the line into an analog signal. Each of the converted pixel data signals is supplied to the data lines DL1 to DLm on the liquid crystal panel 202 through the signal selector 208. R, G and B Pixel data are included in the pixel data for a line. Accordingly, the pixel data signals for one line includes R, G and B pixel data signals. Further, the pixel data signals generated from the data driver 106 have a positive polarity and a negative polarity alternatively with the common voltage Vcom during every period of two horizontal sync signals.

The signal selector 208 alternately supplies pixel data signals from the data driver 206 and a black data signal BD to the data lines DL1 to DLm on the liquid crystal panel 202. The signal selection for the signal selector 208 is decided by a source enable signal SOE. The source enable signal SOE, as depicted in FIGS. 6A and 6B, repetitively has a base logic section (e.g., low logic) choosing the selection of the pixel data signal and a specific logic section (e.g., high logic) choosing the selection of the black data signal BD. In the source enable signal SOE, the base logic section has a period width corresponding to 1H+$\alpha$, but the specific logic section has a period width corresponded to the period 1H−$\alpha$. Further, the specific logic section of the source enable signal SOE has the same phase as the odd-numbered or even-numbered horizontal sync signal included in the vertical scanning interval in accordance with the frames.

Referring to FIG. 6A, for the odd-numbered frame (that is, the odd-numbered vertical scanning interval), the base logic pulse of the source enable signal SOE has the same phase as the odd-numbered horizontal sync signal. The signal selector 208 supplies the pixel data signals from the data driver 206 to the data lines DL1 to DLm on the liquid crystal panel during the period of the odd-numbered horizontal sync signal and the period of '$\alpha$' of the next even-numbered horizontal sync signal. On the other hand, during the rest of the period excluding the period of '$\alpha$' of the next even-numbered horizontal sync signal (1H−$\alpha$), the signal selector 208 supplies the black data signal to the data lines DL1 to DLm on the liquid crystal panel 202. As Vdata of FIG. 6A charges the liquid crystal cells of odd-numbered lines on the liquid crystal panel 202 during the period of '1H+$\alpha$', and black data signals BD charges the liquid crystal cells of even-numbered lines during the period of '1H−$\alpha$'. The video data is displayed on the odd-numbered line of the liquid crystal panel 202, and the black data is displayed on the even-numbered line. Accordingly, the pixel data signal is correctly charged in the liquid crystal cells CLC on the odd-numbered gate lines GL1, GL3, . . . , GLn−1. The pixel data signals charged on the liquid crystal cells on the odd-numbered line have a positive polarity and a negative polarity alternatively progressing in the vertical and horizontal direction. Further, the pixel data signals charged on the liquid crystal cells on the odd-numbered odd line have a positive polarity and a negative polarity alternatively in accordance with the frames. For instance, at the (4k+1)th frame, the pixel data signals of positive polarity is charged in the two of liquid crystal cells on the left side of the first odd line, and the pixel data signals of the negative polarity and the positive polarity are charged in the rest of the liquid crystal cells alternatively as progressing toward the right side and downward. At the (4k+3)th frame, the pixel data signals of negative polarity is charged in the two of the liquid crystal cells on the left side of the first odd-numbered line, and the pixel data signals of the positive polarity and the negative polarity are charged in the rest of the liquid crystal cells alternatively as progressing toward the right side and downward.

As shown in FIG. 6B, for the even-numbered frame (that is, an even-numbered vertical scanning interval), the base logic pulse of the source enable signal SOE has the same phase as the even-numbered horizontal sync signal. The signal selector 208 supplies the pixel data signals from the data driver 206 to the data lines DL1 to DLm during the period of the even-numbered horizontal sync signal and the period of '$\alpha$' of the next odd-numbered horizontal sync signal. On the other hand, during the rest of the period of the next odd-numbered horizontal sync signal excluding the period '$\alpha$', the signal selector 208 supplies the black data signal BD to the data lines DL1 to DLm on the liquid crystal panel 202. As Vdata of FIB. 6B charges the liquid crystal cells on the even-numbered line on the liquid crystal panel 202 during the period of '1H+$\alpha$', and the black data signal BD charges the liquid crystal cells on the right next odd-numbered lines during the period of '1H−$\alpha$'. The video data is displayed on the even-numbered line of the liquid crystal panel 202, and the black data is displayed is displayed on the odd-numbered line. Accordingly, the pixel data signals may be charged exactly, in the liquid crystal cells CLC on the even-numbered gate lines GL2, GL4, . . . , GLn. The pixel data signals charged in the liquid crystal cells on the even-numbered line have positive polarity and negative polarity alternatively as progressed in the vertical and the horizontal direction. Further, the pixel data signals charged on the pixel cells on the even-number line have the positive polarity and negative polarity alternatively. For instance, at the (4k+2)th frame, the pixel data signals of positive polarity are charged on the two liquid crystal cells of the first even-numbered line, and the pixel data signals of the negative polarity and the positive polarity are charged in the rest of the liquid crystal cells alternatively as progressing toward the right side and downwardly. At the (4k)th frame, the pixel data signals of negative polarity are charged in the two of the liquid crystal cells of the left side of the first even-numbered line, and the pixel data signals of the positive polarity and the negative polarity are charged in the rest of the liquid crystal cells alternatively as progressing toward the right side and downwardly.

The liquid crystal display device of FIG. 5 has a timing controller 210 controlling the driving timing of the gate driver 204, the data driver 206 and the signal selector 208. The timing controller 210 generates gate control signals GCS controlling the driving timing of the gate driver 204 and data control signals DCS controlling the driving timing of the data driver 206 and the signal selector 208. The timing controller 210 uses vertical sync signals Vsync, horizontal sync signal Hsync, data endable signal DE and the clock signal CLK from external systems, not illustrated, e.g., graphic modules of computer systems or image demodulating modules of television systems.

Figure 7:
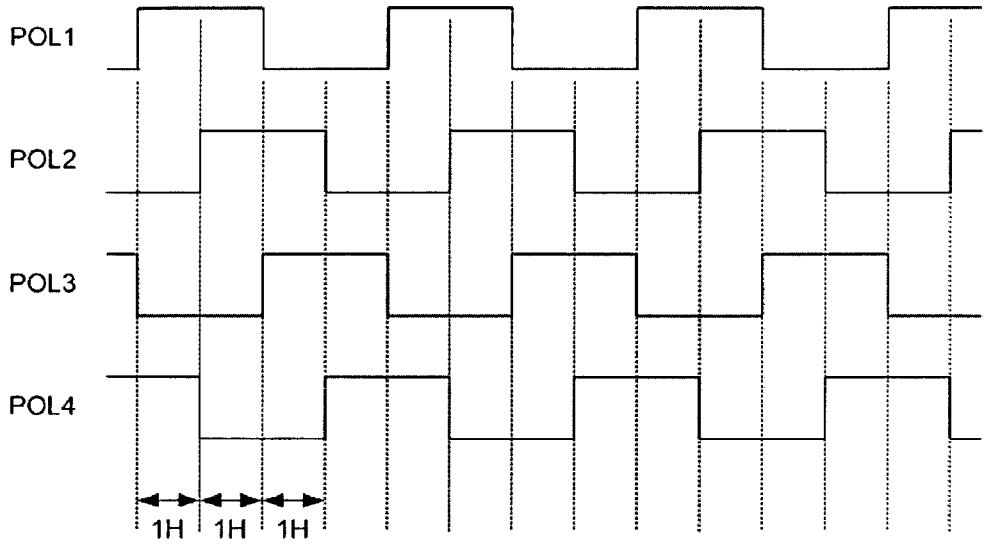
FIG. 7 is a waveform illustrating how polarity inversion signals may be generated in the polarity signal generating section of FIG. 5.

The data signal DCS includes source enable signal SOE, clock signal CLK and polarity inversion signal POL. The polarity inversion signal POL inverts the polarity of the pixel data signal at each of the gate lines, as the polarity is inversed at every period of the two of the horizontal sync signal. Further, the polarity inversion signal POL inverses the polarities of the pixel data signals supplied to the liquid crystal cells on the liquid crystal panel 202 as the phases at every frame is delayed 90 degrees each. Referring to FIG. 7, the polarity inversion signal POL has the same waveform as POL1 on the (4k+1)th frame, the same waveform as POL2 on the (4k+2)th frame, the same waveform as POL3 on the (4k+3)th frame, and has the same waveform as POL4 on the (4k)th frame. Therefore, the pixel data signals having a positive polarity or a negative polarity are generated by the driver 206 when the odd-numbered gate line and the even-numbered gate lines next to the odd-numbered gate line are enabled at the (4k+1)th and (4k+3)th frames. For instance, when the pixel data signals of positive polarity are supplied to the two liquid crystal cells at the left on the first odd-numbered gate line in the (4k+1)th frame, the pixel data signals of negative polarity are supplied to the two liquid crystal cells at left side on the first odd-numbered gate line in the (4k+3)th frame. Further, in the (4k+2)th and (4k)th frames, the pixel data signals of positive polarity or negative polarity are generated by the data driver 206 when the even-numbered gate line and the right next odd-numbered gate line are enabled. For instance, when a pixel data signal with a positive polarity is supplied to the two liquid crystal cells on the left side of the first even-numbered gate line at the (4k+2)th frame, the pixel data signal with a negative polarity is supplied to the two liquid crystal cells on the left side of the first even-numbered gate line in the (4k)th frame. The polarity inversion signal POL generated in the polarity signal generating section 210A installed in the timing controller 210 is supplied to the data driver 206. The description of the source enable signal SOE is omitted, as it may be understood sufficiently with the description on the signal selector 208.

The gate control signals GCS includes the first and the second start pulses GSP1 and GSP2 and a plurality of shift clocks. The first gate start pulse GSP1 is used to generate the gate signals to be supplied to the odd-numbered gate lines GL1, GL3, . . . ,GLn−1, and the second gate start pulse GSP2 is used to generate the gate signals to be supplied to the even-numbered gate lines GL2, GL4, . . . , GLn. The phases of the first and the second gate start pulse GSP1 and GSP2 are different in accordance with the fact that it is the odd-numbered or even-numbered frame.

At the odd-numbered frame, the phase of the first gate start pulse GSP1 is the same to the phase of the horizontal sync signal Hsync, but the phase of the second gate start pulse GPS 2 is advanced by '$\alpha$' versus the phase of the right next horizontal sync signal Hsync as shown in FIG. 6A. That is, the second gate pulse GSP2 has a phase advanced by the period of '$\alpha$' that is subtracted from one horizontal sync signal (that, '1H−$\alpha$') as compared with the first gate start pulse GSP 1. Accordingly, each of the gate signals to be supplied to the odd-numbered gate lines GL1, GL3, GLn−1 is enabled with the right next gate signals to be supplied to the even-numbered gate lines GL2, GL4, . . . , GLn at the same time for a period of '2$\alpha$'. Further, each of the liquid crystal cells CLC on the odd-numbered gate lines GL1, GL3, . . . , Gln−1 charges the pixel data signals during the period of one horizontal sync signals and the additional period of '$\alpha$'. On the other hand, each of the liquid crystal cells CLC on the even-numbered gate lines GL2, GL4, . . . , GLn charges the pixel data signals to be supplied to the liquid crystal cell on the previous odd-numbered gate line during the period of '2$\alpha$' previously, and then, charges the black data signal BD to be supplied to itself during the rest of the period of 1H−α.

At the even-numbered frame, the first gate start pulse GSP1 has a phase advanced by 'α' versus the horizontal sync signal Hsync, but the second gate start pulse GSP 2 has the same phase as the horizontal sync signal Hsync as shown in FIG. 6B. Accordingly, each of the gate signals to be supplied to the even-numbered gate lines GL2, GL4, . . . , GLn−2 is enabled with the gate signals to be supplied to the right next odd-numbered gate lines GL3, GL5, . . . , GLn−1 at the same time for the period of '2α'. Accordingly, each of the liquid crystal cells CLC on the even-numbered gate lines GL2, GL4, . . . , GLn−2 charges the pixel data signals during the period of one horizontal sync signal and the additional period of 'α'. On the other hand, each of the liquid crystal cells CLC on the odd-numbered gate lines GL3, GL5, . . . , GLn−1 charges the pixel data signals to be supplied to the liquid crystal cells on the previous even-numbered gate lines during the period of '2α', and then, charges the black data signal BD to be supplied to itself during the rest period of '1H−α'. In this case, the liquid crystal cells CLC on the first odd-numbered gate line GL1 charges the black data signals BD from the signal selector 208 during the period of '1H−α'. The liquid crystal cells CLC on the last even-numbered gate line GLn also charges the pixel data signals to be supplied from the data driver 206 through the signal selector 208 during the period of '1H+α'.

Further, the timing controller 210 inputs R, G and B pixel data of the frame from external systems. The R, G and B pixel data of the frame are divided into two sub-frames as well as rearranged line by line by the timing controller 210. In this case, the odd-numbered sub-frame includes the pixel data to be supplied to the liquid crystal cells on the odd-numbered gate lines, and the even-numbered sub-frame includes the pixel data to be supplied to the liquid crystal cells on the even-numbered gate lines. The rearranged R, G and B pixel data supplied to the data driver 206 line by line at every cycle of the two horizontal sync signals. Then, the data driver 206 converts the R, G and data of the line into the analog R, G and B pixel data signals every period of two horizontal sync signals. The analog R, G and B pixel data signals are charged in each of the liquid crystal cells CLC of the line through the signal selector 208 and data lines DL1 to DLm on the liquid crystal panel 202 during the period of one horizontal sync signal and the additional period of 'α' (that is, '1H+α').

The generation of motion blurring and the generation of the residual images are minimized as the pixel data signal and the black data signal are charged in the liquid crystal cells on the liquid crystal panel 202 alternatively in accordance with the changes of the lines and the frames. Further, the pixel data signal may be charged in the liquid crystal cells on the liquid crystal panel 202, as the charging time of the pixel data signal becomes longer than the cycle of the horizontal sync signal. Therefore, the images and video quality displayed on the liquid crystal panel 202 are improved.

Figure 8:
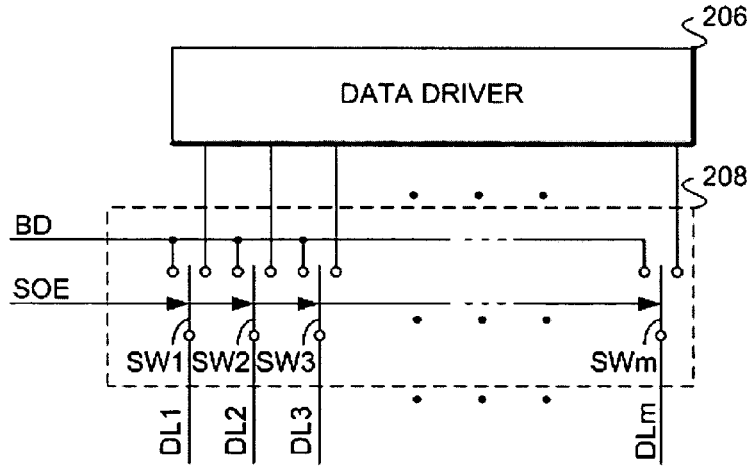
FIG. 8 is a detailed circuit diagram illustrating the signal selector shown in FIG. 5.

FIG. 8 is a detailed circuit diagram illustrating the signal selector 208 illustrated in FIG. 5. Referring to FIG. 8, the signal selector 208 has controlling switches SW1 to SWm connected to each of the data lines DL1 to DLm on the liquid crystal panel 202. Each of the standard points of contact of the controlling switches SW1 to SWm are connected with the data lines DL1 to DLm on the liquid crystal panel 202. All of the first select contacts of the controlling switches SW1 to SWm are connected with the data driver 206. The second select contacts of the controlling switches SW1 to SWm input the black data signal BD from the timing controller 210, commonly. The controlling switches SW1 to SWm transmit the black data signal BD and the pixel data signals from the data driver 206 to the data lines on the liquid crystal panel 202 selectively, in response to the source enable signal SOE from the timing controller 210. For instance, when the source enable signal SOE maintains the base logic (e.g., low logic) the controlling switches SW1 to SWm transmit the pixel data signal from the data driver 206 to the data lines DL1 to DLm on the liquid crystal panel 202. When the source enable signal SOE is the specific logic (that is, high logic), the controlling switches SW1 to SWm supply the black data signal from the timing controller 210 to the data lines DL1 to DLm on the liquid crystal panel 202.

Figure 9:
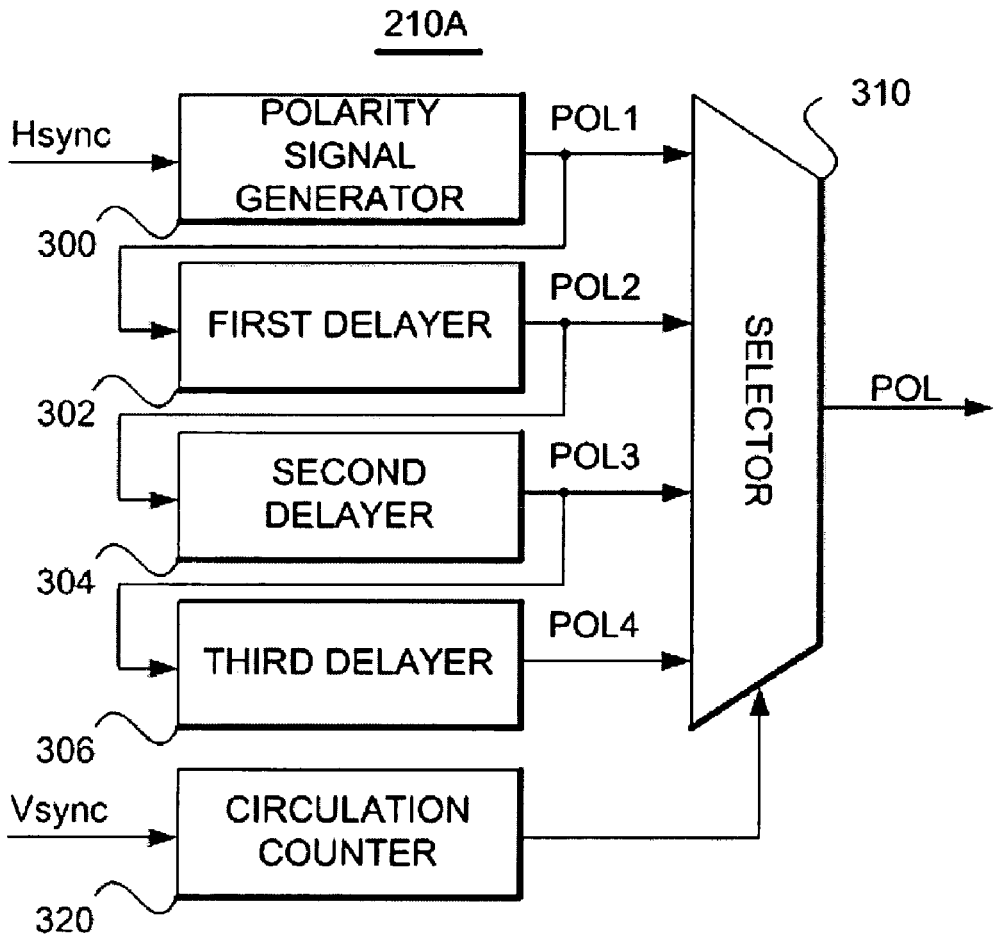
FIG. 9 is a detailed block diagram illustrating the polarity signal generating section shown in FIG. 5.

FIG. 9 is a detailed block diagram illustrating the polarity signal generating section 210A illustrated in FIG. 5, in detail. The polarity signal generating section 210A of FIG. 9 includes a selector 310 inputting the first to fourth polarity inversion signal POL1 to POL4 from the polarity signal generator 300 and first to third delayers 302, 304, and 306 and a circulation counter 320 replying to the vertical sync signal Vsync. The polarity signal generator 300 generates the first polarity inversion signal POL1 such as the signal shown in FIG. 7, by frequency-driving the horizontal sync signal by ¼. The first to third delayers 302 to 306 connected serially to the polarity signal generator 300. Further, each of the first to third delayers 302 to 306 delay the polarity inversion signal from the polarity signal generator 300 or a previous delayer 302 or 304 by the period of one horizontal sync signal. That is, the first delayer 302 generates the second polarity inversion signal POL2 as the same thing in FIG. 7, by delaying the first polarity inversion signal POL1 from the polarity signal generator 300 for the period of one horizontal sync signal. The second delayer 304 generates the third polarity inversion signal POL3 as the same thing in FIG. 7, by delaying the second polarity inversion signal POL2 from the first delayer 302 for the period of one horizontal sync signal. The third delayer 306 generates the fourth polarity inversion signal POL4 as the same thing in FIG. 7, by delaying the third polarity inversion signal POL3 from the second delayer 304 for the period of one horizontal sync signal. The selector 310 selects one of the first to fourth polarity inversion signals POL1 to POL4 from the polarity signal generator 300 and the first to fourth delayers 302 to 306, and supplies the one to the data driver 206 depicted in FIG. 5. The circulation counter 320 counts by incrementing whenever one of the rising and falling edges of the vertical sync signal Vsync is entered and supplies the count data to the selector 310 as a selection control signal. The count data from the circulation counter 320 has value from 0 to 3 as a way of circulate-repeat. Accordingly, the selector 310 replying to the control data from the circulation counter 320 supplies the first polarity inversion signal POL1 at the (4k+1)th frame, the second polarity inversion signal POL2 at the (4k+2)th frame, the third polarity inversion signal POL3 at the (4k+3)th frame, and the fourth polarity inversion signal POL4 at the (4k)th frame to the data driver 206 shown in FIG. 5.

As described above, the liquid crystal display device according to the present invention has some advantages in that the pixel data signals are correctly charged in the liquid crystal cells on the liquid crystal panel, as extending the charging time of the liquid crystal cells on the liquid crystal panel longer than the cycle of the horizontal sync signal. Accordingly, the liquid crystal display device according to the present invention is capable of providing video images in a good video quality even at a high frame frequency.

The liquid crystal display device according to the present invention has some advantages in that the generation of the motion blurring and the residual images is minimized, as the pixel data signal and the black data signal are charged in the liquid crystal cells on the liquid crystal panel alternatively in accordance with the changes of the lines and frames. Further, the pixel data signal is correctly charged in the liquid crystal cells on the liquid crystal panel, as the charging time of the pixel data signal becomes longer than the cycle of the horizontal sync signal. The liquid crystal display device according to the present invention is capable of providing video images having rare residual images as well as improving the video quality of the video images displayed on the liquid crystal panel better.

It will be apparent to those skilled in the art that various modifications and variations can be made in the present invention without departing from the spirit and scope of the invention. Thus, it is intended that the present invention cover the modifications and variations of this invention provided they come within the scope of the appended claims and their equivalents.

What is claimed is:

1. A liquid crystal display device comprising:

a liquid crystal panel;

a horizontal sync signal having a horizontal period;

a gate driver that supplies a plurality of gate signals sequentially to a plurality of gate lines, wherein a first gate line provides a gate signal with a gate pulse width equal to the horizontal period $+\alpha$ and a second gate line provides a gate signal with a gate pulse width equal to the horizontal period $+\alpha$ so that gates signals on the first and second gate lines overlap by $2\alpha$ and wherein the first and second gate lines are adjacent to one another; and a data driver that supplies pixel data signals to a plurality of data lines on the liquid crystal panel during every period of the horizontal sync signals, wherein the period '$\alpha$' is set shorter than the period of one horizontal sync signal, wherein the first gate line is one of a plurality of odd-numbered gate lines and the second gate line is one of a plurality of even-numbered gate lines, wherein the gate signals supplied to odd-numbered gate lines and one of the adjacent even-numbered gate lines among the plurality of gate lines are enabled at the same time during the period of '$2\alpha$'.

2. The liquid crystal display device according to claim 1, wherein the first gate signal has the same phase as the horizontal sync signal and the second gate signal has an advanced phase of $\alpha$ versus the horizontal sync signal.

3. The liquid crystal display device according to claim 1, wherein pixel data supplied on a first data line to pixels along the first and second gate lines have a first polarity and the pixel data supplied to the next two succeeding gate lines have a second polarity opposite to the first polarity and wherein pixel data supplied on a second data line adjacent to the first data line along the first and second gate lines have a second polarity.

4. The liquid crystal display device according to claim 3, wherein the data driver inverts the polarities of the pixel data signals supplied to each pixel in the liquid crystal panel with every frame.

5. A liquid crystal display device comprising:

a liquid crystal panel;

a horizontal sync signal having a horizontal period;

a gate driver that supplies a plurality of gate signals sequentially to a plurality of gate lines, wherein a first gate line provides a gate signal with a gate pulse width equal to the horizontal period $+\alpha$ and a second gate line provides a gate signal with a gate pulse width equal to the horizontal period $+\alpha$ so that gates signals on the first and second gate lines overlap by $2\alpha$ and wherein the first and second gate lines are adjacent to one another;

a data driver that produces pixel data signals corresponding to a plurality of data lines on the liquid crystal panel during each period of the horizontal sync signals; and a signal selector connected to the data driver that supplies a black data signal and the pixel data signals from the data driver alternatively to the data lines, wherein a signal election for the signal selector is decided by a source enable signal, the source enable signal has a base logic section choosing the selection of the pixel data signal and a specific logic section choosing the selection of the black data signal, wherein the base logic section of the source enable signal has a period width corresponding to the horizontal period $+\alpha$, the specific logic section of source enable signal has a period width correspond to the horizontal period $-\alpha$, wherein the period '$\alpha$' is set shorter than the period of one horizontal sync signal, wherein the first gate line is one of a plurality of odd-numbered gate lines and the second gate line is one of a plurality of even-numbered gate lines.

6. The liquid crystal display device according to claim 5, wherein a first gate signal overlaps one of the before and after the second gate signals on an odd-numbered gate lines in accordance with the frames.

7. The liquid crystal display device according to claim 6, wherein the gate signals have phase differences corresponding to the period $\alpha$.

8. The liquid crystal display device according to claim 7, wherein the even-numbered gate signal has a phase advanced by $\alpha$ versus the horizontal sync signal when the odd-numbered gate signal has the same phase as the horizontal sync signal and the odd-numbered gate signal has a phase advanced by $\alpha$ versus the horizontal sync signal when the even-numbered gate signal has the same phase as the horizontal sync signal.

9. The liquid crystal display device according to claim 5, wherein the signal selector supplies the pixel data signal to the data line during the period of horizontal period $+\alpha$, and supplies the black data signal to the data line during the period of horizontal period $-\alpha$.

10. The liquid crystal display device according to claim 9, wherein the data driver outputs the pixel data signals every two horizontal periods.

11. The liquid crystal display device according to claim 10, wherein the data driver inverts the polarities of the pixel data signals supplied to each pixel in the liquid crystal panel with every two frames.

12. A driving method of a liquid crystal display device comprising:

supplying a plurality of gate signals sequentially to a plurality of gate lines, wherein a first gate line provides a gate signal with a gate pulse width equal to a horizontal period $+\alpha$ and a second gate line provides a gate signal with a gate pulse width equal to the horizontal period $+\alpha$ so that gates signals on the first and second gate lines overlap by $2\alpha$ and wherein the first and second gate lines are adjacent to one another; and supplying pixel data signals to a plurality of data lines on the liquid crystal panel during every period of the horizontal sync signals, wherein the first gate signal has the same phase as the horizontal sync signal and the second gate signal has an advanced phase of $\alpha$ versus the horizontal sync signal, wherein the period 'α' is set shorter than the period of one horizontal sync signal, wherein the gate signals supplied to the odd-numbered gate line and the next even-numbered gate line of the gate lines are enabled at the same time during the period of '2α.'

13. The liquid crystal display device according to claim 12, wherein pixel data supplied on a first data line to pixels along the first and second gate lines have a first polarity and the pixel data supplied to the next two succeeding gate lines have a second polarity opposite to the first polarity and wherein pixel data supplied on a second data line adjacent to the first data line along the first and second gate lines have a second polarity.

14. A driving method of a liquid crystal display device comprising:

supplying a plurality of gate signals sequentially to a plurality of gate lines, wherein a first gate line provides a gate signal with a gate pulse width equal to a horizontal period +α and a second gate line provides a gate signal with a gate pulse width equal to the horizontal period +α so that gates signals on the first and second gate lines overlap by 2α and wherein the first and second gate lines are adjacent to one another; and producing pixel data signals corresponding to a plurality of data lines on the liquid crystal panel during each period of the horizontal sync signals; and supplying a black data signal and the pixel data signals alternatively to the data lines, wherein the pixel data signal and the black data signal is selected by a source enable signal having a base logic section choosing the selection of the pixel data signal and a specific logic section choosing the selection of the black data signal, wherein the base logic section of the source enable signal has a period width corresponding to the horizontal period +α, the specific logic section of source enable signal has a period width correspond to the horizontal period −α, wherein the period 'α' is set shorter than the period of one horizontal sync signal.

15. The driving method of a liquid crystal display device according to claim 14, wherein the first gate line is one of a plurality of odd-numbered gate lines and the second gate line is one of a plurality of even-numbered gate lines and wherein the even-numbered gate signal has a phase advanced by α versus the horizontal sync signal when the odd-numbered gate signal has the same phase as the horizontal sync signal and the odd-numbered gate signal has a phase advanced by a versus the horizontal sync signal when the even-numbered gate signal has the same phase as the horizontal sync signal.

16. The driving method of the liquid crystal display device according to claim 14, wherein supplying the black data signal and the pixel data signals includes supplying the pixel data signal to the data line during the period of horizontal period +α and supplying the black data signal to the data line during the period of horizontal period −α.

17. The driving method of the liquid crystal display device according to claim 14, wherein the pixel data signals are output every two horizontal periods.

* * * * *